US011499341B2

(12) United States Patent
Schlezinger

(10) Patent No.: US 11,499,341 B2
(45) Date of Patent: Nov. 15, 2022

(54) ELECTRICAL ASSEMBLY

(71) Applicant: General Electric Technology GmbH, Baden (CH)

(72) Inventor: Cristian Gheorghe Schlezinger, Staffordshire (GB)

(73) Assignee: General Electric Technology Gmbh, Baden (CH)

( * ) Notice: Subject to any disclaimer, the term of this patent is extended or adjusted under 35 U.S.C. 154(b) by 621 days.

(21) Appl. No.: 16/271,045

(22) Filed: Feb. 8, 2019

(65) Prior Publication Data

US 2019/0242156 A1 Aug. 8, 2019

(30) Foreign Application Priority Data

Feb. 8, 2018 (EP) ..... 18155802

(51) Int. Cl.
*E05B 47/00* (2006.01)
*H01H 47/00* (2006.01)

(52) U.S. Cl.
CPC ..... *E05B 47/0002* (2013.01); *H01H 47/002* (2013.01); *E05B 2047/0069* (2013.01); *H01H 2047/006* (2013.01); *H01H 2047/009* (2013.01)

(58) Field of Classification Search
CPC ..... E05B 2047/0069; E05B 17/22; E05B 2047/0068; E05B 2047/0073; E05B 47/00; E05B 47/0001; E05B 63/0065; E05B 2047/0067; E05B 2047/0048; E05B 39/00; E05B 2047/0008; E05B 47/0002; H01H 47/002; H01H 2047/006; H01H 2047/009
See application file for complete search history.

(56) References Cited

U.S. PATENT DOCUMENTS 4,648,253 A * 3/1987 Imhoff ..... E05B 47/0047 292/210
5,911,460 A * 6/1999 Hawkins ..... E05B 63/248 292/254
8,686,869 B2 * 4/2014 Sharma ..... G01D 5/268 340/686.2
10,704,293 B2 * 7/2020 Almomani ..... G01R 31/44
(Continued)

FOREIGN PATENT DOCUMENTS

EP 3312549 A1 4/2018

OTHER PUBLICATIONS

European Search Report and Written Opinion dated Jul. 31, 2018 which was filed in connection with EP 18155802.4 which was filed on Feb. 8, 2017.

*Primary Examiner* — Mark A Williams
(74) *Attorney, Agent, or Firm* — Eversheds Sutherland (US) LLP

(57) ABSTRACT

There is provided an electrical assembly comprising of a latching device including a latching member configured to be positionable in a first position and a second position, the latching device further including an actuator configured to selectively move the latching member between the first and second positions and an operating state detection unit configured to detect an abnormal operating state of the latching device; and a controller configured to selectively drive the actuator to move the latching member to a selected one of the first and second positions in response to the detection of the abnormal operating state.

13 Claims, 3 Drawing Sheets

(56) References Cited

U.S. PATENT DOCUMENTS

| | | | | |
|---|---|---|---|---|
| 2010/0139338 | A1* | 6/2010 | Wintersteiger | E05B 47/0607 70/78 |
| 2012/0194106 | A1* | 8/2012 | Hille | A47C 20/041 318/3 |
| 2012/0326456 | A1* | 12/2012 | Picard | E05B 9/02 292/144 |
| 2014/0021725 | A1* | 1/2014 | Baty | E05B 47/026 292/144 |
| 2014/0165673 | A1* | 6/2014 | Tyner | E05B 17/00 70/141 |
| 2016/0017638 | A1* | 1/2016 | Dore Vasudevan | E05B 17/22 292/137 |
| 2016/0032621 | A1* | 2/2016 | Johnson | G07C 9/00309 292/144 |
| 2016/0133071 | A1* | 5/2016 | Henderson | G07C 9/0069 70/277 |
| 2016/0145904 | A1* | 5/2016 | Lowder | E05B 47/00 340/542 |
| 2021/0222460 | A1* | 7/2021 | Sims | E05B 47/0047 |

* cited by examiner

ELECTRICAL ASSEMBLY

BACKGROUND OF THE DISCLOSURE

This invention relates to an electrical assembly and to a method of operating an electrical assembly, particularly for use in switching relay applications.

It is known to use a latching device with a latching member moveable between first and second positions, where the latching member may be held in either or both of the first and second positions. Such a device may be used to selectively open and close an electrical circuit.

BRIEF SUMMARY

According to a first aspect of the invention, there is provided an electrical assembly comprising:

- a latching device including a latching member configured to be positionable in a first position and a second position, the latching device further including an actuator configured to selectively move the latching member between the first and second positions;
- an operating state detection unit configured to detect an abnormal operating state of the latching device; and
- a controller configured to selectively drive the actuator to move the latching member to a selected one of the first and second positions in response to the detection of the abnormal operating state.

It will be understood that the invention is applicable to electrical assemblies with a latching member configured to be positionable in two or more different positions, i.e. the latching member is not limited to being positionable in only the first and second positions. For example, the latching member may be moveable by the actuator to the first position, the second position and at least one other position.

The provision of the operating state detection unit and the controller in the electrical assembly of the invention enables the selective movement of the latching member to the selected one of the first and second positions following the occurrence of the abnormal operating state. This allows the position of the latching member to be controlled so that the latching device is in a desired state when the latching device is restored to a normal operating state. This is advantageous in applications where the latching device is required to be in a certain state in order to improve the performance of or prevent damage to the latching device and/or associated equipment.

In embodiments of the invention, the actuator may be an electrically operated actuator which is configured to be electrically connectable to an electrical power source to allow a power supply from the electrical power source to the actuator. In such embodiments, the operating state detection unit may include a power supply detection unit, and the abnormal operating state may include a turn-off or loss of power supply from the electrical power source to the actuator.

It will be understood that the turn-off or loss of power supply from the electrical power source to the actuator may be intentional or unexpected, and may be scheduled or unscheduled.

The provision of the power supply detection unit and the controller in the electrical assembly of the invention enables the selective movement of the latching member to the selected one of the first and second positions following the turn-off or loss of power supply. This allows the position of the latching member to be controlled so that the latching device is in a desired state when the power supply from the electrical power source to the actuator is restored. This is advantageous in applications where the latching device is required to be in a certain state upon power-on in order to improve the performance of or prevent damage to the latching device and/or associated equipment.

In contrast, as seen in electrical assemblies with conventional latching devices, the absence of the aforementioned power supply detection unit and controller means that the turn-off or loss of power supply would prevent the operation of the actuator to move the latching member to the selected position. As a result, the latching member can only be maintained in its last position, thus resulting in the latching device having an uncontrolled state upon power-on. This runs the risk of degrading the performance of or damaging the latching device and/or associated equipment.

A conventional non-latching device is designed to have a fixed state in the event of a turn-off or loss of power supply, which avoids the problem associated with the conventional latching device having an uncontrolled state upon power-on. On the other hand the conventional non-latching device has the downside of requiring a constant supply of power in its energised position and therefore a higher operating temperature when compared to a latching device. The ability of the invention to provide a configurable position of the latching member following the turn-off or loss of power supply enables a latching device to replace the conventional non-latching device while avoiding the problem associated with the conventional latching device having an uncontrolled state upon power-on, thus providing the benefits of reduced power consumption and lower operating temperature associated with latching devices which improves performance and reliability. This may be advantageously applied to, for example, applications with power saving requirements or with critical power dissipation and/or operating temperature requirements, since the invention enables the latching device to operate with reduced power dissipation and thereby run at cooler temperatures in comparison to the conventional non-latching device.

In addition the ability of the invention to control the position of the latching member following the turn-off or loss of power supply allows the latching device of the invention to be used in new ways, such as in applications requiring a controlled state of the latching device upon power-on.

Furthermore, by way of the invention permitting the positioning of the latching member in either of the first and second positions following the turn-off or loss of power supply, the latching device of the invention is provided with multiple controlled states following the turn-off or loss of power supply, unlike the conventional non-latching device which is limited to a fixed state following the turn-off or loss of power supply.

In further embodiments of the invention, the electrical assembly may include a position detection unit, wherein the position detection unit includes a sensing device configured to detect the position of the latching member, and the position detection unit may be configured to communicate the detected position of the latching member to the controller.

This enables the controller to decide whether it is necessary to drive the actuator to move the latching member to the selected one of the first and second positions in response to the detection of the abnormal operating state. If the latching member is not in a desired position, then the controller drives the actuator to move the latching member to the selected position. If the latching member is already in a desired position, then there is no need for the actuator to move the latching member to the selected position. This is particularly advantageous for when the latching member has multiple stable positions but only one or some, but not all, of the multiple stable positions are desirable for the latching member when there is an abnormal operating state of the latching device.

During its operation, the latching device may experience an unexpected event, such as an application of an external mechanical force to the latching member, which could result in an accidental change in position of the latching member.

In embodiments of the invention employing the use of a position detection unit, the operating state detection unit may include the position detection unit. In such embodiments, the abnormal operating state may include a mismatch between the detected position of the latching member and a target position of the latching member.

Configuration of the electrical assembly of the invention in this manner enables the detection of the change in position of the latching member, which in turn allows the controller to correct the position of the latching member to match the target position of the latching member. This allows the latching device to resume normal operation instead of being in a state which could negatively affect the performance of or cause damage to the latching device and/or associated equipment.

The invention is applicable to electrical assemblies based on different configurations of latching devices for use in a wide range of applications. Non-limiting examples of such electrical assemblies are described as follows.

In embodiments of the invention, the latching member may include an armature, and the actuator may include an inductive coil, the armature arranged to be moveable between the first and second positions when the inductive coil is energised.

In such embodiments employing the use of the aforementioned position detection unit, the sensing device may be configured to detect an inductance of the inductive coil or a characteristic that corresponds to the inductance of the inductive coil, the position detection unit further configured to determine the position of the armature based on the detected inductance or the detected characteristic.

The ability to confirm the mechanical position of an armature permits the invention to provide information on the state of the latching device. Having a position detection unit capable of detecting an inductance of the inductive coil or a characteristic that corresponds to the inductance of the inductive coil and determining the position of the armature based on the detected inductance or the detected characteristic provides a reliable and cost-effective way of confirming the position of the armature.

The inductance of the inductive coil is influenced by the position of the armature since the armature affects the magnetic circuit of the coil. As such, detecting the inductance of the inductive coil or a characteristic that corresponds to the inductance of the inductive coil permits the position of the armature to be determined.

Detecting an inductance of the inductive coil means that the inductance of the inductive coil is directly obtained. Detecting a characteristic that corresponds to the inductance of the inductive coil means that a value that corresponds to the inductance of the inductive coil, e.g. current, time, rate of change of current, rate of change of voltage or voltage, is obtained.

Optionally the electrical assembly may include a local power source configured to selectively supply power to one or more components of the electrical assembly. The local power source may be configured to supply power for operating the operating state detection unit, the controller and/or any other component of the electrical assembly mentioned in this specification. This provides a reliable means for enabling the driving of the actuator to move the latching member to the selected one of the first and second positions in response to the detection of the abnormal operating state.

In further embodiments of the invention, the latching device may be a latching switching device, such as a relay, a circuit breaker or any other type of switching device. In such embodiments, the latching member may include at least one contact element.

The invention is particularly useful for applications in which the latching relay is required to be in a certain state following the occurrence of the abnormal operating state. For example, there may be a need to ensure that the latching relay is in a certain state following the occurrence of the abnormal operating state so that an associated electrical circuit is in a standby configuration while waiting for the restoration of the normal operating state of the latching device. This not only optimises the performance of the electrical circuit while on standby, but also prevents the undesirable scenario of the electrical circuit being in the wrong configuration, which could potentially damage the electrical circuit and/or associated equipment.

Alternatively the latching device may be an electromechanical actuator, a trip coil solenoid or any other type of non-switching device.

According to a second aspect of the invention, there is provided a method of operating an electrical assembly, the electrical assembly comprising a latching device including a latching member configured to be positionable in a first position and a second position, the latching device further including an actuator configured to selectively move the latching member between the first and second positions, the method comprising the steps of:

- detecting an abnormal operating state of the latching device; and
- selectively driving the actuator to move the latching member to a selected one of the first and second positions in response to the detection of the abnormal operating state.

The advantages of the electrical assembly of the first aspect of the invention and its embodiments apply mutatis mutandis to the method of the second aspect of the invention and its embodiments.

In embodiments of the second aspect of the invention, the actuator may be an electrically operated actuator which is configured to be electrically connectable to an electrical power source to allow a power supply from the electrical power source to the actuator. In such embodiments, the abnormal operating state may include a turn-off or loss of power supply from the electrical power source to the actuator.

In further embodiments of the second aspect of the invention, the method of the invention may include the step of detecting the position of the latching member. In such embodiments, the abnormal operating state may include a mismatch between the detected position of the latching member and a target position of the latching member.

In the method of the invention, the latching member may include an armature, and the actuator may include an inductive coil, the armature arranged to be moveable between the first and second positions when the inductive coil is energised.

The method of the invention may include the steps of detecting an inductance of the inductive coil or a characteristic that corresponds to the inductance of the inductive coil, and determining the position of the armature based on the detected inductance or the detected characteristic.

The method of the invention may include the step of selectively supplying power from a local power source to one or more components of the electrical assembly.

In the method of the invention, the latching device may be a switching device, an electromechanical actuator, a trip coil solenoid or any other type of non-switching device.

DETAILED DESCRIPTION

Figure 1:
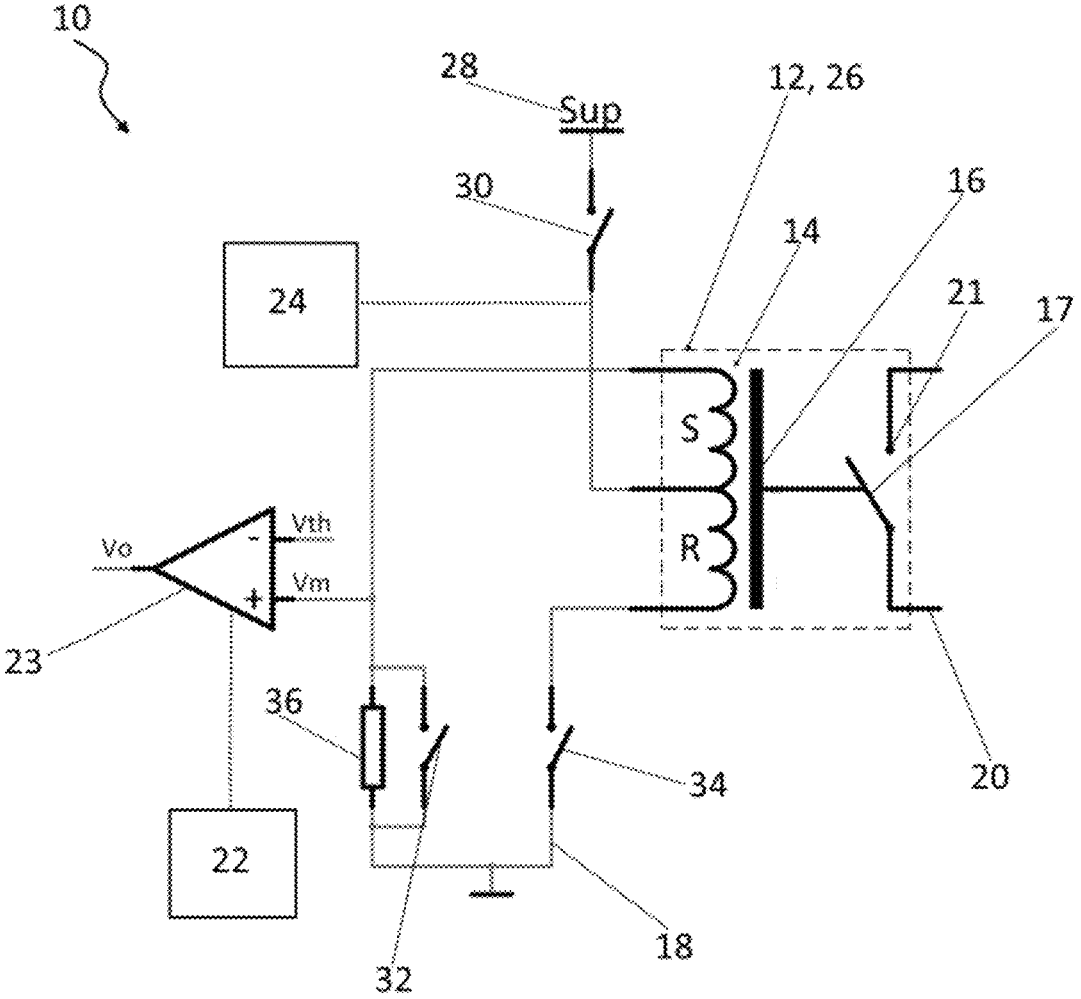
FIG. 1 shows a schematic view of an electrical assembly according to an embodiment of the invention with an armature in a first position.

An electrical assembly according to an embodiment of the invention is shown in FIG. 1 and is designated generally by the reference numeral 10.

The electrical assembly 10 includes a latching device in the form of a latching relay 12. As such, the electrical assembly 10 is a switching assembly 10 in the embodiment shown. In other embodiments of the invention, the latching device may instead be a non-switching device, such as an electromechanical actuator or a trip coil solenoid.

The latching relay 12 includes an inductive coil 14 and an armature 16. The armature 16 is arranged to be moveable between first and second positions when the inductive coil 14 is energised.

The armature 16 includes a moveable contact 17 which is moveable with the armature 16 between the first and second positions. In the embodiment shown, the moveable contact 17 is mechanically linked to the armature 16 e.g. via a pivot. In other embodiments of the invention, the moveable contact 17 may not be mechanically linked to the armature 16 and may instead be mechanically linked to another part of the switching assembly 10 which permits movement of the moveable contact 17 when the armature 16 abuts the moveable contact 17.

In still other embodiments of the invention, the armature 16 may be integrally formed with the moveable contact 17.

The inductive coil 14 forms part of an input circuit 18, and the armature 16 (in particular the moveable contact 17) forms part of an output circuit 20. In the embodiment shown, the input circuit 18 operates at a lower current than the output circuit 20. In other embodiments of the invention the output circuit 20 may instead operate at a lower or the same current as the input circuit 18. In further other embodiments of the invention the inductive coil 14 forms part of an output circuit while the armature 16 (in particular, the moveable contact 17) forms part of an input circuit.

FIG. 1 shows the armature 16 in the first position wherein the armature 16 has moved the moveable contact 17 to an open position relative to a fixed contact 21 of the output circuit 20 such that current is prevented from flowing through the output circuit 20.

Figure 3:
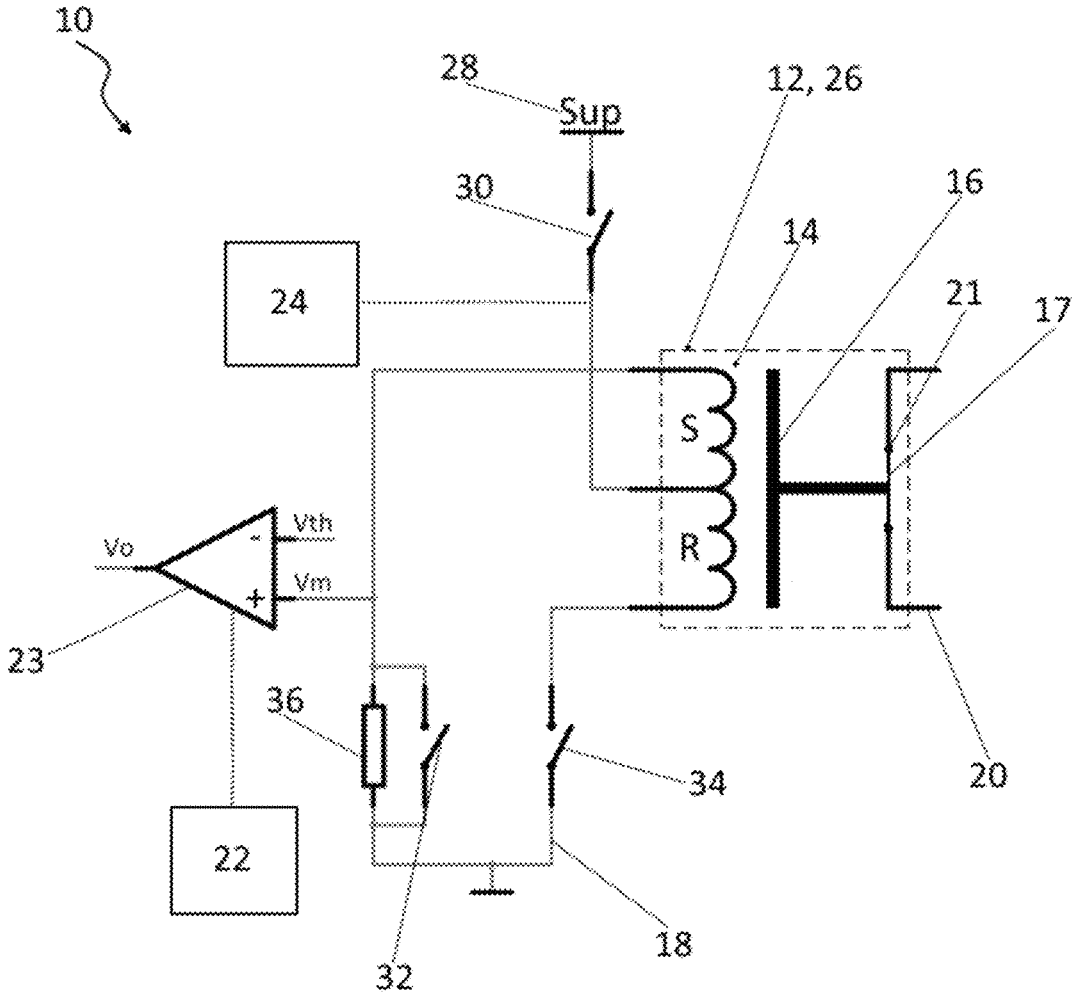
FIG. 3 shows a schematic view of the electrical assembly of FIG. 1 with the armature in a second position.

FIG. 3 shows the armature 16 in the second position wherein the armature 16 has moved the moveable contact 17 to a closed position relative to the fixed contact 21 of the output circuit 20 such that current is permitted to flow through the output circuit 20.

The latching relay 12 may be a "normally open" device wherein the armature 16 is in the first position by default. In other embodiments however the latching relay 12 may instead be a "normally closed" device wherein the armature 16 is in the second position by default.

Figure 2A:
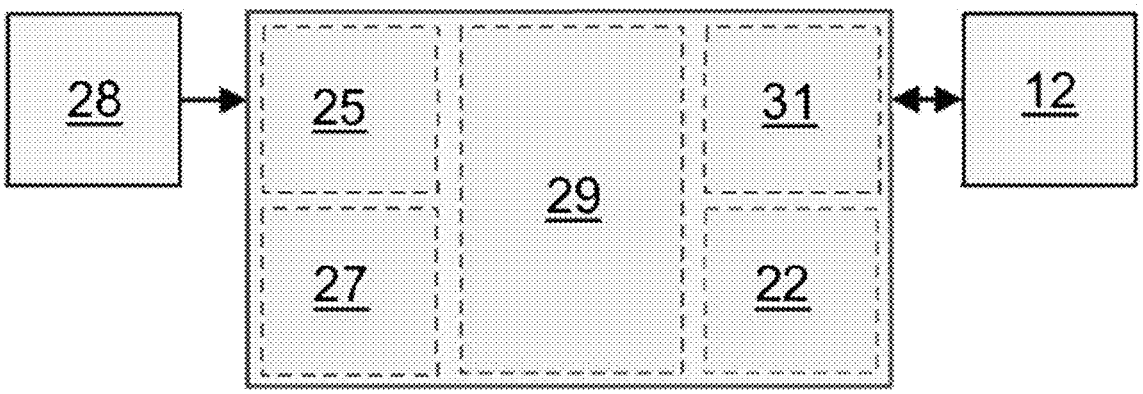
FIGS. 2A and 2B show schematic views of a controller, a power supply detection unit, a position detection unit and a local power source of the electrical assembly of FIG. 1.

The electrical assembly 10 further includes a controller, a power supply detection unit 25, a position detection unit 22, and a local power source 27, as shown in FIG. 2A. The controller includes a processor 29 and a relay driver 31. The local power source 27 is in the form of an energy-storing capacitor which supplies power to the position detection unit 22 and the controller. In other embodiments, the capacitor may be replaced by a battery or by another independent power source.

The position detection unit 22 is configured to detect an inductance of the inductive coil 14 or a characteristic that corresponds to an inductance of the inductive coil 14. The position detection unit 22 is further configured to determine the position of the armature 16 based on the detected inductance or detected characteristic, and to communicate the detected position of the armature 16 to the processor 29 via an electrical signal.

The switching assembly 10 further still includes a control unit 24 which is configured to control the voltage across the inductive coil 14 so as to apply a voltage step to the inductive coil 14.

In particular, the control unit 24 is configured to control the magnitude of the voltage step so that the voltage across the inductive coil 14 is controlled at a value that maintains the position of the armature 16, i.e. it does not cause movement of the armature 16.

The magnitude of the voltage step applied to the inductive coil 14 may be controlled so that the voltage across the inductive coil 14 is controlled at a value lower than the voltage required to move the armature 16 between the first and second positions. Alternatively, the magnitude of the voltage step applied to the inductive coil 14 may be controlled so that the voltage across the inductive coil 14 is controlled at a value equal to or higher than the voltage required to move the armature 16 but is applied to the inductive coil 14 for an amount of time that is not long enough to influence the position of the armature 16 at that value.

A voltage step lower than the voltage required to move the armature 16 could be applied while the inductive coil 14 is de-energised (i.e. while there is no current flow through the inductive coil 14). Another option would be to apply a nominal voltage step but for a very short duration with respect to the mechanical inertia of the latching device 12 such that the mechanical inertia of the armature 16 will not allow the armature 16 to move. The nominal voltage could then be applied while the inductive coil 14 is either energised or de-energised.

A voltage step could be applied while the inductive coil 14 is energised (i.e. while there is a current flow through the inductive coil 14). Such a voltage step could be applied in several ways such that the voltage across the inductive coil 14 is increased (e.g. doubled), thus increasing the force on the armature 16 being held in the current position. Alternatively, the voltage step could be applied for a short period of time. Any other type of voltage step pattern can be applied which does not move the armature 16 out of position.

The position detection unit 22 is configured to detect the inductance of the inductive coil 14 or a characteristic that corresponds to the inductance of the inductive coil 14 in response to the voltage step being applied to the inductive coil 14 by the control unit 24.

In the embodiment shown, the position detection unit 22 is configured to detect a characteristic that corresponds to the inductance of the inductive coil 14. In particular, the position detection unit 22 is configured to monitor a rate of change of current of the inductive coil 14 when the voltage step is applied to the inductive coil 14. The position detection unit 22 may instead be configured to directly detect the inductance of the inductive coil 14.

The relationship between the inductance of an electrical circuit, the current through the circuit and the voltage across the circuit is shown below:

$$v(t) = L\frac{di}{dt}$$

Such a relationship can be utilised when applying the voltage step v(t) to the inductive coil and monitoring the rate of change of current $$\frac{di}{dt}$$

of the inductive coil 14 to detect the inductance L of the inductive coil 14.

The position detection unit 22 includes a sensing device which senses the current of the inductive coil 14. The sensing device in the embodiment shown is part of a voltage comparator unit 23, which not only senses the current of the inductive coil 14 via a voltage measurement, but also compares the voltage measurement to a voltage threshold. The voltage comparator unit 23 may instead be a current comparator which directly measures the current of the inductive coil 14 and compares it with a current threshold. The voltage comparator 23 may instead be an inductance comparator which directly measures the inductance of the inductive coil 14 and compares it with an inductance threshold.

The position detection unit 22 also includes a timing unit (not shown) which detects a time interval for the current of the inductive coil 14 to reach a current threshold when the voltage step is applied. The current threshold may be a final steady state current value or may instead be a predetermined current threshold.

The voltage comparator unit 23 forms part of a higher-level comparator (not shown) which is configured to compare the detected characteristic with a reference characteristic threshold. In the embodiment shown, the detected characteristic is compared with a reference characteristic value. In other embodiments of the invention, the detected characteristic may be compared with a reference characteristic range.

The detected characteristic may be a rate of change of current across the inductive coil 14 which is compared to a reference rate of change of current value. The detected characteristic may instead be a rate of change of voltage across the inductive coil 14 which is compared to a reference rate of change of voltage value.

The detected characteristic may instead be a time interval for the current (or voltage) across the inductive coil 14 to reach the threshold current (or voltage) value which is then compared to a reference time interval value.

Alternatively, the timing unit may set a fixed time for the current of the inductive coil 14 to be measured by the sensing device. The current, or rate of change of current, after the fixed time may then be compared to a reference current, or rate of change of current, value so as to determine the position of the armature 16.

To obtain the reference characteristic value to which the detected characteristic is compared, the switching assembly 10 includes a calibration unit (not shown) which performs a self-calibration of the switching assembly 10 by measuring the characteristic that corresponds to the inductance of the inductive coil 14 with the armature 16 in the first and second positions (or any other possible positions of the armature 16). The switching assembly 10 may include a self-calibration circuit (not shown) with software which will command the latching device 12 to move the armature 16 to one of the first and second positions and then measure the inductance (or a characteristic thereof) in each of the positions. A reference characteristic value will then be computed by the calibration unit. Once the reference characteristic value is computed by the calibration unit, that reference characteristic value will be used to decide the position of the armature 16 by comparing the detected characteristic with the reference characteristic value.

In an alternative embodiment of the invention, the reference characteristic value is determined externally to the switching assembly 10 and is instead stored and/or hard-coded into the latching device 12.

The latching device 12 in the embodiment shown is an electromechanical relay, in particular a latching relay 26 which is configured to selectively hold the armature 16 in position when the inductive coil 14 is de-energised. The latching relay 26 may also be known in the art as an "impulse", "keep" or "stay" relay.

How a latching relay 26 holds an armature 16 in position is known in the art. For example, the latching relay 26 may include two opposing inductive coils 14 with an over-centre spring or permanent magnet to hold the armature 16 in position after the inductive coil 14 is de-energised, wherein a pulse to one inductive coil 14 moves the armature 16 to the first position and a pulse to the opposite inductive coil 14 moves the armature 16 to the second position.

The position detection unit 22 is configured to detect the characteristic that corresponds to the inductance of the inductive coil 14 when the inductive coil 14 is de-energised.

Returning to the embodiment shown in the figures, the latching relay 26 includes first and second independent inductive coils S, R. The first coil S is known as a "set coil" and the second coil is known as a "reset coil".

The input circuit 18 is connected to the first and second inductive coils S, R such that a current can be separately supplied to the first and second inductive coils S, R so as to separately energise the inductive coils S, R, and thus move the armature 16 to one of the first and second positions.

In particular, an electrical power source 28 is connected into and out of the input circuit 18 via a supply switching element 30 in order to allow a power supply from the electrical power source 28 to the first and second inductive coils S, R. The input circuit 18 also includes a first coil switching element 32 and a second coil switching element 34. To energise the first inductive coil S, both the supply switching element 30 and the first coil switching element 32 must be closed while the second coil switching element 34 is open. To energise the second inductive coil R, both the supply switching element 30 and the second coil switching element 34 must be closed while the first coil switching element 32 is open.

Switching of the supply switching element 30 and the first and second coil switching elements 32, 34 is controlled by the control unit 24.

The input circuit 18 further includes a resistive element 36 which is connected in parallel with the first coil switching element 32. The resistive element 36 permits the detecting unit 22 to sense the current of the first inductive coil S since it permits the voltage across the resistive element 36 to be measured, which is proportional to the current of the first inductive coil S.

The position detection unit 22 and the control unit 24 may form part of the same unit or may instead be separate units.

In other embodiments of the invention, the latching device 12 may include a fewer or higher number of inductive coils 14. In further embodiments of the invention, the latching relay 12 may be replaced by a different type of latching switching device such as a circuit breaker.

The latching device 12 may further include one or more magnetic cores (not shown) around which a respective inductive coil 14 is wrapped. The or each magnetic core may be a piece of ferromagnetic material such as iron.

To move the armature 16 from the first position (FIG. 1) to the second position (FIG. 3), the control unit 24 closes both the supply switching element 30 and the first inductive coil switching element 32 for a predetermined amount of time to permit a current to flow through the first inductive coil S so as to energise the first inductive coil S enough to move the armature 16. The armature 16 is moved by the energised first inductive coil S from the first position by which the moveable contact 17 is in an open position relative to the output circuit 20 (i.e. the "reset position") to the second position by which the moveable contact 17 is in a closed position relative to the output circuit 20 (i.e. the "set position").

The control unit 24 then opens the supply switching element 30 and the first inductive coil switching element 32, thus ceasing the current flow through the first inductive coil S which de-energises the first inductive coil S.

Since the latching device 12 shown is a latching relay 26, the armature 16 is held in the second position (i.e. the last position of the armature 16) while the first inductive coil S is de-energised.

To move the armature 16 from the second position (FIG. 3) back to the first position (FIG. 1), the control unit 24 closes both the supply switching element 30 and the second inductive coil switching element 34 for a predetermined amount of time to permit a current to flow through the second inductive coil R so as to energise the second inductive coil R enough to move the armature 16. The armature 16 is moved by the energised second inductive coil R from the second position to the first position.

The control unit 24 then opens the supply switching element 30 and the second inductive coil switching element 34, thus ceasing the current flow through the second inductive coil R which de-energises the second inductive coil R.

Again, since the latching device 12 shown is a latching relay 26, the armature 16 is held in the first position (i.e. the last position of the armature 16) while the second inductive coil R is de-energised.

During the operation of the latching device 12, a turn-off or loss of power supply from the electrical power source 28 to the first and second inductive coils S, R may take place, whereby such a turn-off or loss of power supply may be intentional or unexpected or may be scheduled or unscheduled.

The power supply detection unit 25 is configured to detect a turn-off or loss of power supply from the electrical power source 28 to the first and second inductive coils S, R, and to communicate information about the turn-off or loss of power supply to the processor 29.

Figure 2B:
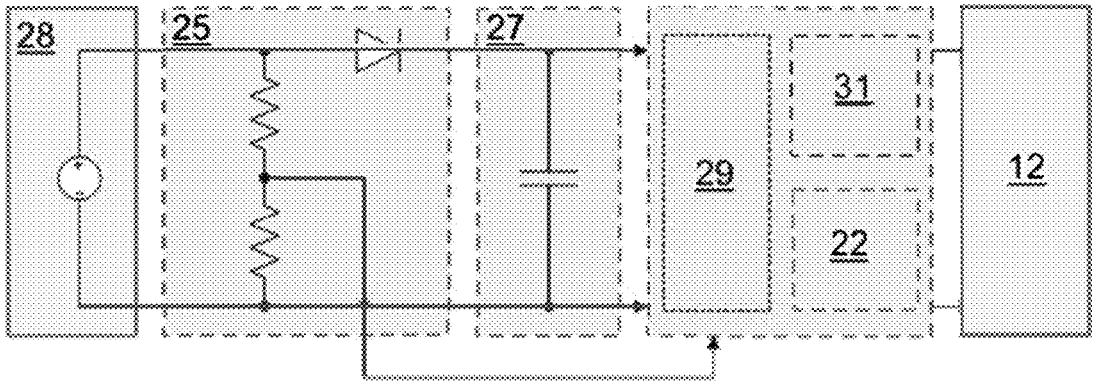

FIG. 2B shows an exemplary implementation of the power supply detection unit 25 in which an anode side of a diode is connected to the electrical power source 28, a cathode side of the diode is connected to the processor 29, and a voltage divider is connected across the electrical power source 28 at the anode side of the diode, with a mid-point between a pair of resistors of the voltage divider being connected to the processor 29. In addition the capacitor 27 is connected between the cathode side of the diode and the processor 29. Upon turn-off or loss of the power supply from the electrical power source 28, the anode side of the diode goes to 0 which can be sensed by the processor 29 through the voltage divider. Meanwhile the arrangement of the capacitor 27 permits the processor 29 to draw power from the capacitor 27 to enable its operation.

It is envisaged that, in other embodiments, the power supply detection unit 25 may implemented in a different manner. For example, the power supply detection unit 25 may be implemented as a dedicated integrated power supply monitoring integrated circuit, which can be powered by the capacitor 27.

The processor 29 is configured to receive the information about the turn-off or loss of power supply from the power supply detection unit 22, and to send a command to the relay driver 31 to drive either of the first and second inductive coils S, R in order to move the armature 16 from its last position (which is either of the first and second positions) to the other of the first and second positions. The driving of the first or second inductive coil S, R is carried out by drawing power from the capacitor 27 to energise the first or second inductive coil S, R. It is envisaged that the power for energising the first or second inductive coil S, R may be instead drawn from another independent power source, such as a battery. In this manner the controller is configured to selectively drive the inductive coils S, R to move the armature 16 to a selected one of the first and second positions in response to the detection of the turn-off or loss of power supply.

Optionally the position detection unit 22 can be used to determine the position of the armature 16, which will then be communicated to the processor 29. This enables the processor to decide whether it is necessary to command the relay driver 31 to drive either of the first and second inductive coils S, R in order to move the armature 16. If the armature 16 is not in a desired position, then the processor 29 commands the relay driver 31 to drive either of the first and second inductive coils S, R in order to move the armature 16 to the other position. If the armature 16 is already in a desired position, then there is no need to drive either of the first and second inductive coils S, R to move the armature 16 to the other position.

In order to detect the position of the armature 16, the control unit 24 is implemented to apply the voltage step to the first inductive coil S. The voltage step does not influence the present position of the armature 16. This might be achieved by the voltage step being kept lower than the voltage required to move the armature 16 between the first and second positions, or by the voltage step being applied for an amount of time that does not permit the armature 16 to move between the first and second positions.

In the embodiment shown, the voltage step is applied by the control unit 24 closing the supply switching element 30 so that current starts to flow through the first inductive coil S and the resistive element 36. As the current flow builds up the voltage $V_m$ across the resistive element 36 also increases.

When the supply switching element 30 is closed, the timing unit activates.

The comparator unit 23, which in this embodiment is a voltage comparator, compares the voltage $V_m$ across the resistive element 36 to a voltage threshold $V_{th}$. When the voltage $V_m$ across the resistive element 36 reaches the voltage threshold $V_{th}$, the comparator unit 23 will output a toggle, e.g. it will output a high digital signal $V_o$.

The timing unit deactivates once the comparator unit 23 outputs the digital signal, i.e. it stops timing. Thus a time interval for the voltage $V_m$ across the resistive element 36 to reach the voltage threshold $V_{th}$ is obtained.

The amount of time it takes for the voltage $V_m$ across the resistive element 36 to reach the voltage threshold $V_{th}$ is dependent on the time it takes for the current to build up across the first inductive coil S, which in turn is dependent on the inductance of the first inductive coil S. In this way, a characteristic that corresponds to the inductance of the first inductive coil S is detected.

The position detection unit 22 then compares the time interval obtained by the timing unit (i.e. the detected characteristic) to a reference time interval value (i.e. the reference characteristic threshold—which in this case is a value) to determine the position of the armature 16.

The voltage threshold $V_{th}$ may be a final steady state voltage value. The voltage threshold $V_{th}$ may instead be another voltage which is pre-measured and indicative of the armature 16 being in a particular position.

In other embodiments of the invention, the position detection unit 22 may instead calculate the rate of change of current during the time interval and then compare the rate of change of current (i.e. the detected characteristic) to a rate of change of current reference value (i.e. the reference characteristic threshold) to determine the position of the armature 16.

In further embodiments of the invention, the position detection unit 22 may instead calculate the rate of change of voltage during the time interval and then compare the rate of change of voltage (i.e. the detected characteristic) to a rate of change of voltage reference value (i.e. the reference characteristic threshold) to determine the position of the armature 16.

In further still embodiments of the invention, the position detection unit 22 may instead measure the current during the time interval and then compare the measured current (i.e. the detected characteristic) to a current reference value (i.e. the reference characteristic threshold) to determine the position of the armature 16.

In further still embodiments of the invention, the position detection unit 22 may instead calculate the inductance (using the equation as set out previously in the application) or directly detect the inductance of the first inductive coil S and then compare the detected inductance to a reference inductance value (i.e. the reference inductance threshold) to determine the position of the armature 16.

In further still embodiments of the invention, the timing unit may stop after a predetermined time interval and the position detection unit 22 may measure the current, voltage, rate of change of current or rate of change of voltage at the end of the time interval (i.e. the detected characteristic). The measured current, voltage, rate of change of current or rate of change of voltage may then be compared to a reference current, reference voltage, reference rate of change of current, or reference rate of change of voltage value (i.e. the reference characteristic threshold) so as to determine the position of the armature 16.

The steps outlined above are for use with a particular type of latching relay 26 as shown in the figures which includes two inductive coil windings. However, the same idea of detecting the inductance (or a characteristic thereof) of the inductive coil 14 in order to determine the position of the armature 16 can be applied to any other relay or relay like devices, such as actuators, circuit breakers etc. by implementing an identical or similar position detection unit 22 without affecting the normal operation of the latching device 12, and also to any other device that includes an inductive coil and an armature, with the armature arranged to be moveable between first and second positions when the inductive coil is energised.

The configuration of the switching assembly 10 of FIGS. 1 and 3 therefore enables the selective movement of the armature 16 to the selected one of the first and second positions following the turn-off or loss of power supply, which enables the control of the position of the armature 16 to ensure that the switching relay 12 is in a certain state following the turn-off or loss of power supply so that the output circuit 20 is in a standby configuration when the power supply from the electrical power source 28 to the inductive coils S, R is restored. This not only allows the switching relay 12 to be used in new ways, such as in applications requiring a controlled state of the switching relay 12 upon power-on, but also provides the switching relay 12 with multiple controlled states following the turn-off or loss of power supply. In addition the invention enables the switching relay 12 to replace the conventional non-latching relay while avoiding the problem associated with the conventional latching relay having an uncontrolled state upon power-on, thus providing the benefits of reduced power consumption and lower operating temperature associated with latching relays which improves performance and reliability.

In addition, during its operation, the latching device 12 may experience an unexpected event, such as the application of excessive mechanical shock or vibration to the latching device 12, which could result in an accidental change in position of the armature 16.

As detailed above, the position detection unit 22 is configured to detect the position of the armature 16 and communicate the detected position of the armature 16 to the processor 29.

The processor 29 is programmed to obtain the target position of the armature 16 from, for example, an internal memory, an internal hard-coded data source, or an external data source. The target position of the armature 16 at a given point in time depends on the requirements of the operation of the latching device 12. The processor 29 then compares the detected position of the armature 16 and the target position of the armature 16, and decides whether it is necessary to command the relay driver 31 to drive either of the first and second inductive coils S, R in order to move the armature 16. If there is a mismatch between the detected position of the armature 16 and the target position of the armature 16, then the processor 29 commands the relay driver 31 to drive either of the first and second inductive coils S, R in order to move the armature 16 to the other position. If the detected position of the armature 16 is the same as the target position of the armature 16, then there is no need to drive either of the first and second inductive coils S, R to move the armature 16 to the other position.

The switching assembly 10 of FIGS. 1 and 3 is therefore capable of initialising a corrective action to enable the selective movement of the armature 16 to a selected one of the first and second positions in response to an unexpected change in the position of the armature 16, which allows the latching device 12 to resume normal operation instead of being in a state which could negatively affect the performance of or cause damage to the latching device 12 and/or associated equipment.

It is envisaged that, in other embodiments of the invention, the switching assembly may be configured to enable the selective movement of the armature to the selected one of the first and second positions in response to one, instead of both, of: the turn-off or loss of power supply; and the mismatch between the detected position of the armature and the target position of the armature. For the latter in which the switching assembly is configured to be responsive to the mismatch between the detected position of the armature and the target position of the armature, the power supply detection unit may be omitted from the switching assembly.

It will be appreciated that the invention is also applicable to other abnormal operating states of the latching device in addition to the aforementioned turn-off or loss of power supply and the mismatch between the detected position of the armature 16 and the target position of the armature, where the switching assembly is required to enable the selective movement of the armature to a selected one of the first and second positions following the occurrence of the abnormal operating state(s).

I claim:

1. An electrical assembly for use in switching relay applications having a latching switching device, the electrical assembly comprising:

a latching switching device including a latching member configured to be positionable in a first position and a second position, the latching switching device further including an actuator configured to selectively move the latching member between the first and second positions;

an operating state detection unit configured to detect an abnormal operating state of the latching device, wherein the operating state detection unit comprises a power supply detection unit and a position detection unit configured to detect an inductance of the inductive coil or a characteristic that corresponds to the inductance of the inductive coil, the position detection unit further configured to determine the position based on the detected inductance or the detected characteristic, and wherein the abnormal operating state comprises a turn-off or loss of power supply to the actuator;

a power source configured to supply power to a controller and the position detection unit; and the controller comprising a processor and a relay driver, wherein the processor is configured to send a command to the relay driver to drive at least one inductive coil of the actuator to move the latching member to a selected one of the first and second positions in response to the detection of the abnormal operating state.

2. The electrical assembly according to claim 1 wherein the actuator is an electrically operated actuator which is configured to be electrically connectable to the power source.

3. The electrical assembly according to claim 1, wherein the position detection unit includes a sensing device configured to detect the position of the latching member, and the position detection unit is configured to communicate the detected position of the latching member to the controller.

4. The electrical assembly according to claim 3, and the abnormal operating state includes a mismatch between the detected position of the latching member and a target position of the latching member.

5. The electrical assembly according to claim 1 wherein the latching member includes an armature, the armature arranged to be moveable between the first and second positions when the inductive coil is energised.

6. The electrical assembly according to claim 5 wherein the position detection unit includes a sensing device configured to detect an inductance of the inductive coil or a characteristic that corresponds to the inductance of the inductive coil, the position detection unit further configured to determine the position of the armature based on the detected inductance or the detected characteristic.

7. The electrical assembly according to claim 1 wherein the latching switching device is a switching device, an electromechanical actuator, or a trip coil solenoid.

8. A method of operating an electrical assembly, the electrical assembly for use in switching relay applications having a latching switching device, the electrical assembly comprising a latching switching device including a latching member configured to be positionable in a first position and a second position, the latching switching device further including an actuator configured to selectively move the latching member between the first and second positions, a power source configured to supply power to a controller and a position detection unit of an operating state detection unit, the position detection unit configured to detect an inductance of the inductive coil or a characteristic that corresponds to the inductance of the inductive coil, the position detection unit further configured to determine the position based on the detected inductance or the detected characteristic, the method comprising:

detecting an abnormal operating state of the latching device, wherein the abnormal operating state comprises a turn-off or loss of power supply to the actuator; and sending a command from a processor of a controller to a relay driver of the controller to drive at least one inductive coil of the actuator to move the latching member to a selected one of the first and second positions in response to the detection of the abnormal operating state.

9. The method according to claim 8 wherein the actuator is an electrically operated actuator which is configured to be electrically connectable to the electrical power source.

10. The method according to claim 8 including detecting the position of the latching member.

11. The method according to claim 10 wherein the abnormal operating state includes a mismatch between the detected position of the latching member and a target position of the latching member.

12. The method according to claim 8 wherein the latching member includes an armature, the armature arranged to be moveable between the first and second positions when the inductive coil is energised.

13. The method according to claim 12, the method including detecting an inductance of the inductive coil or a characteristic that corresponds to the inductance of the inductive coil, and determining the position of the armature based on the detected inductance or the detected characteristic.

* * * * *